United States Patent [19]

Kreeger

[11] Patent Number: 4,711,002

[45] Date of Patent: Dec. 8, 1987

[54] BAG TIE WITH PRESS RELEASE LEVER

[75] Inventor: Elsmer W. Kreeger, Howell, Mich.

[73] Assignee: Pinckney Molded Plastics, Inc., Howell, Mich.

[21] Appl. No.: 3,372

[22] Filed: Jan. 14, 1987

[51] Int. Cl.[4] ..... B65D 77/10

[52] U.S. Cl. ..... 24/30.5 P; 24/16 PB; 24/17 AP; 292/318

[58] Field of Search ..... 24/16 PB, 17 AP, 30.5 P; 292/318, 321, 322; 248/74.3, 74.5

[56] References Cited

U.S. PATENT DOCUMENTS

| | | | |
|---|---|---|---|
| 3,072,986 | 1/1963 | Lefnaer | 24/16 |
| 3,597,803 | 8/1971 | Van Neil | 24/16 PB |
| 3,606,648 | 9/1971 | Schuler | 24/16 PB |
| 3,855,669 | 12/1974 | Meyer | 24/16 PB |
| 3,900,923 | 8/1975 | Thomas | 24/16 PB |
| 3,979,094 | 9/1976 | DeWitt | 248/60 |
| 4,001,919 | 1/1977 | Moberg et al. | 24/16 PB |
| 4,093,288 | 6/1978 | Suzuki | 292/321 |
| 4,236,280 | 12/1980 | Kreiseder | 24/16 PB |
| 4,240,183 | 12/1980 | Sumimoto et al. | 24/16 PB |
| 4,272,900 | 6/1981 | MacLarty et al. | 40/21 C |
| 4,317,262 | 3/1982 | Wells, Jr. | 24/16 PB |
| 4,439,896 | 4/1984 | Matsui | 24/16 PB |
| 4,466,160 | 8/1984 | de Lima Castro Netto | 24/30.5 R |
| 4,506,415 | 3/1985 | Swift | 24/16 PB |
| 4,537,432 | 8/1985 | Meeks | 292/318 |
| 4,586,570 | 5/1986 | Swift | 169/75 |

*Primary Examiner*—Victor N. Sakran

*Attorney, Agent, or Firm*—Basile and Hanlon

[57] ABSTRACT

A closure device with a press release lever is disclosed. The closure device includes an elongated member having a longitudinal axis, a retaining housing at one end, a flexible middle section, and a free end portion at another end. The retaining housing has a first wall connected to the middle section, a second wall opposing the first wall, third and fourth walls opposing each other and formed integrally with the first and second walls. A lever is connected to the first wall for releasably retaining the flexible middle section. The lever includes a middle-section-engaging surface, a press-to-release-actuating end, and is biased against movement in one direction. A passage is formed in the retaining housing for receiving the free end portion and the flexible middle section. Various shapes of the flexible middle section are disclosed for releasably retaining the flexible middle section in an engaged position within the retaining housing in cooperation with the middle-section-engaging surface of the lever. The free end portion has a tapered surface tapering away from the middle section.

16 Claims, 11 Drawing Figures

BAG TIE WITH PRESS RELEASE LEVER

BACKGROUND OF THE INVENTION

I. Field of the Invention

The invention relates to closure devices, generally made of plastic for closing articles such as bags and, more particularly, closure devices having means for releasing the closure device.

II. Description of the Prior Art

A variety of closure devices are generally speaking known in the art. For examples, see U.S. Pat. Nos. 4,586,570; 4,506,415; 4,272,900; 4,240,183; 4,093,288; and 4,001,919. In addition, closure devices with means for releasing the closure device are generally known in the art. For examples, see U.S. Pats. Nos. 4,537,432; 4,466,160; 4,439,896; 4,317,262; 4,236,280; 3,979,094; and 3,072,986.

BRIEF SUMMARY OF THE INVENTION

The present invention is a closure device or bag tie having a press release lever. The device is generally shaped as an elongated member having a longitudinal axis, a retaining housing at one end, a flexible middle section and a free end portion at another end. The retaining housing has a first wall connected to the middle section, a second wall opposing the first wall, third and fourth walls opposing each other and formed integrally with the first and second walls. In addition, the retaining housing has lever means connected to the first wall for releasably retaining the flexible middle section. The lever means includes a middle-section-engaging surface, a press-to-release-actuating end, and is biased against movement in one direction. The retaining housing has passage means for receiving the free end portion and the flexible middle section through the retaining housing. The flexible middle section includes shaped means for releasably retaining the flexible middle section in an engaged position with the retaining housing in cooperation with the middle-section-engaging surface of the lever means. The free end portion has a tapered surface tapering away from the middle section.

It is a desirable characteristic of the present invention to provide an improved plastic closure device that is simple in construction and operation, and capable of nondestructive disengagement of the closure device. It is also a desirable characteristic of the present invention to provide an improved closure device with a lever extending inwardly toward the middle portion from the retaining housing to provide accessibility by the user for releasing the closure device from a locked position. A further desirable characteristic of the present invention is to provide an improved closure device having a lever extending outwardly from the middle section within the retaining housing while protruding above the retaining housing for access by the user to release the closure device from a locking position wherein the middle portion is engaged between the lever and two opposing walls of the retaining housing.

Various embodiments and configurations of the present invention make these and other desirable characteristics and advantages of the present invention apparent to those skilled in the art on reading the following description.

BRIEF DESCRIPTION OF THE DRAWINGS

In the various views, like numerals refer to like elements, wherein.

DESCRIPTION OF THE PREFERRED EMBODIMENTS

Figure 1:
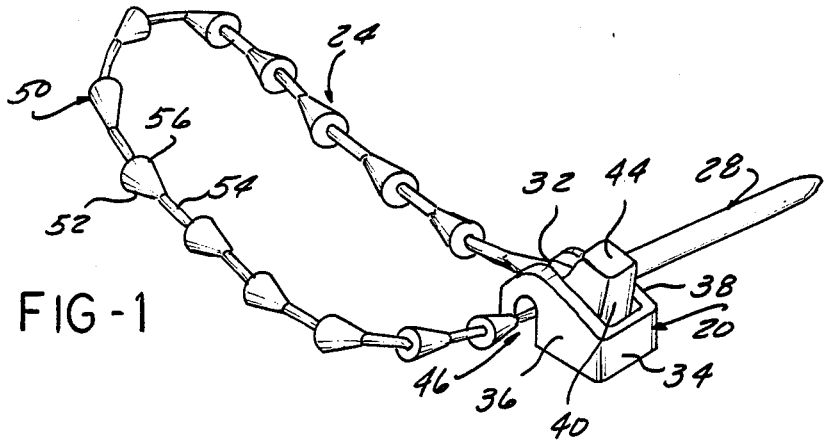
FIG. 1 is a perspective view of a first embodiment of the improved closure device of the present invention.
Figure 2:
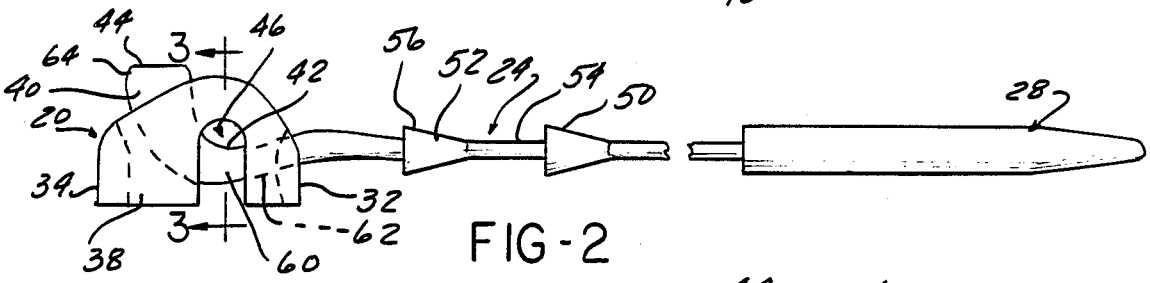
FIG. 2 is a side view of the improved closure device of FIG. 1.

A first embodiment of the present invention is shown in a perspective view in FIG. 1. The device is shaped generally as an elongated member having a longitudinal axis, a retaining housing 20 is located at one end, a flexible middle section 24 connects the retaining housing 20 to a free end portion 28 located at the opposite end of the elongated member. The retaining housing has a first wall 32 connected to the middle section 24. A second wall 34 opposes the first wall 32. Third and fourth walls, 36 and 38 respectively, oppose each other and are formed integrally with the first wall 32 and the second wall 34 in the retaining housing 20. The retaining housing 20 has lever means 40 connected to the first wall 32 for releasably retaining the middle section 24. The lever means 40 includes a middle-section-engaging surface 42, a press-to-release-actuating end 44, and is biased against movement in one direction. The retaining housing 20 also includes passage means 46 for receiving the free end portion 28 and the flexible middle section 24 through the retaining housing 20. The flexible middle section 24 has shaped means 50 for releasably retaining the middle section 24 in an engaged position within the retaining housing 20 in cooperation with the middle-section-engaging surface 42 of the lever means 40. The free end portion 28 has a tapered surface tapering away from the middle section 24.

Figure 4:
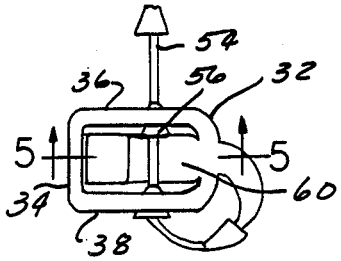
FIG. 4 is a top view of the improved closure device of FIG. 1.
Figure 3:
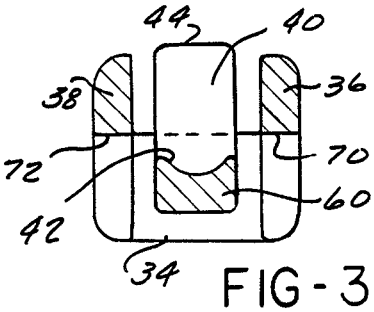
FIG. 3 is a sectional view of the retaining housing of the improved closure device as shown in FIG. 2.
Figure 5:
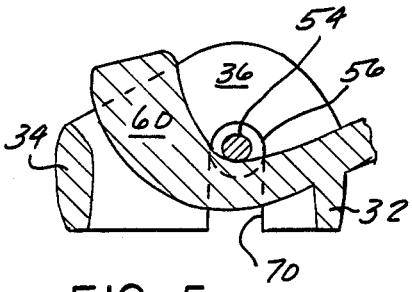
FIG. 5 is a sectional side view of the improved closure device as shown in FIG. 4, with the lever in a locking position.
Figure 6:
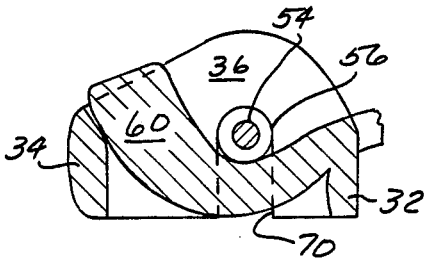
FIG. 6 is a cross-sectional view of the improved closure device similar to FIG. 5 with the lever in a released position.

Referring to FIG. 1 through FIG. 6, the first embodiment of the present invention includes shaped means 50 comprising a plurality of lanceolate members 52 interconnected with a narrow end 54 of each lanceolate member 52 oriented toward the free end portion 28 and an enlarged outer extremity end 56 of each lanceolate member 52 oriented toward the retaining housing 20. The lever means 40 can comprise a corniculate lever 60 connected at a narrow end 62 to the first wall 32 and disposed between the third and fourth walls, 36 and 38 respectively, with an enlarged outer extremity end 64 extending above the second wall 34. The lever 60 has a middle-section-engaging surface 42 on the concave side of the lever 60. In addition, the construction of the lever 60 causes it to be biased against pivotal movement of the enlarged outer extremity end 64 below the second wall 34. The passage means, in the first embodiment of the present invention, comprises two opposing slots, 70 and 72 respectively, extending upwardly from the bottom of the third and fourth walls, 36 and 38 respectively. The passage means 46 is used in conjunction with the middle-section-engaging surface 42 of the lever 60 to lock the middle section 24 in a desired position, as shown in FIG. 5, and to release the middle section 24 from the locked position when the lever 60 is depressed as shown in FIG. 6.

As shown in FIGS. 1 and 4, in the first embodiment of the present invention the free end portion 28 can be bent toward the retaining housing 20 and threaded through the passage means 46. Drawing the free end portion 28 through the pair of opposing slots, 70 and 72 respectively, in the third and fourth walls, 36 and 38 respectively, causes the flexible middle section 24 to be drawn into the passage means 46. The lever means 40 clamps the narrow end 54 of one of the plurality of lanceolate members 52 between the lever 60 and the ends of the two opposing slots, 70 and 72 respectively. The enlarged outer extremity end 56 of an adjacent lanceolate member 52 prevents the flexible middle section 24 from being moved in a disengaging direction. Further movement in the engaging direction is permitted due to the shape of the lanceolate members 52. To release the middle section 24, the press-to-release-actuating end, such as the enlarged outer extremity end 64 of lever 60, is depressed which moves the lever 60 away from the ends of the two opposing slots, 70 and 72 respectively, creating an enlarged passage means 46 allowing the enlarged outer extremity end 56 of the lanceolate member 52 to pass freely through the retaining housing 20.

A second embodiment of the present invention is shown in FIGS. 7 through 10. As in the previous embodiment, the closure device is generally an elongated member having a longitudinal axis, a retaining housing 20 at one end, a flexible middle section 24, and a free end portion 28 at another end. The retaining housing 20 has a first wall 32 connected to the middle section 24, a second wall 34 opposing the first wall, as well as third and fourth walls, 36 and 38 respectively, opposing each other and formed integrally with the first and second walls, 32 and 34 respectively. The retaining housing also has lever means 40 connected to the first wall 32 for releasably retaining the middle section 24. The lever means 40 includes a middle-section-engaging surface 42, a press-to-release-actuating end 44, and is biased against movement in one direction. Finally, the retaining housing 20 also has passage means 46 for receiving the free end portion 28 and the middle section 24 through the retaining housing 20. The flexible middle section 24 has shaped means 50 for releasably retaining the middle section 24 in an engaged position within the retaining housing 20 in cooperation with the middle-section-engaging surface 42 of the lever means 40. The free end portion 28 has a tapered surface tapering away from the middle section 24.

In the second embodiment, the free end portion 28 is formed having a flat, relatively smooth, laterally tapered, rectangular shape. The middle section 24 has shaped means 50 comprising a plurality of longitudinally spaced, lateral serrations 152 disposed on a bottom surface of the middle section 28. The lever means 40 can comprise a relatively flat member, such as lever 160. The passage means 46 can comprise a rectangular opening through the retaining housing 20, such as passage 170, which is positioned in between the third and fourth walls, 36 and 38 respectively, while being adjacent to the second wall 34 and spaced from the first wall 32.

The free end portion 28 of the second embodiment can be threaded through the passage 170 in the retaining housing 20. The middle-section-engaging surface 42 of the lever 160 engages with the plurality of longitudinally spaced, lateral serrations 152 such that the lever 160 resists disengaging movement of the middle section 24 while allowing further engaging movement of the middle section 24, and permitting disengaging movement of the middle section 24 when the press-to-release-actuating end of lever 160 is depressed to create an enlarged passage 170 allowing the middle section 24 to pass freely through the retaining housing 20.

Figures 7, 8, 9, 10, 11:
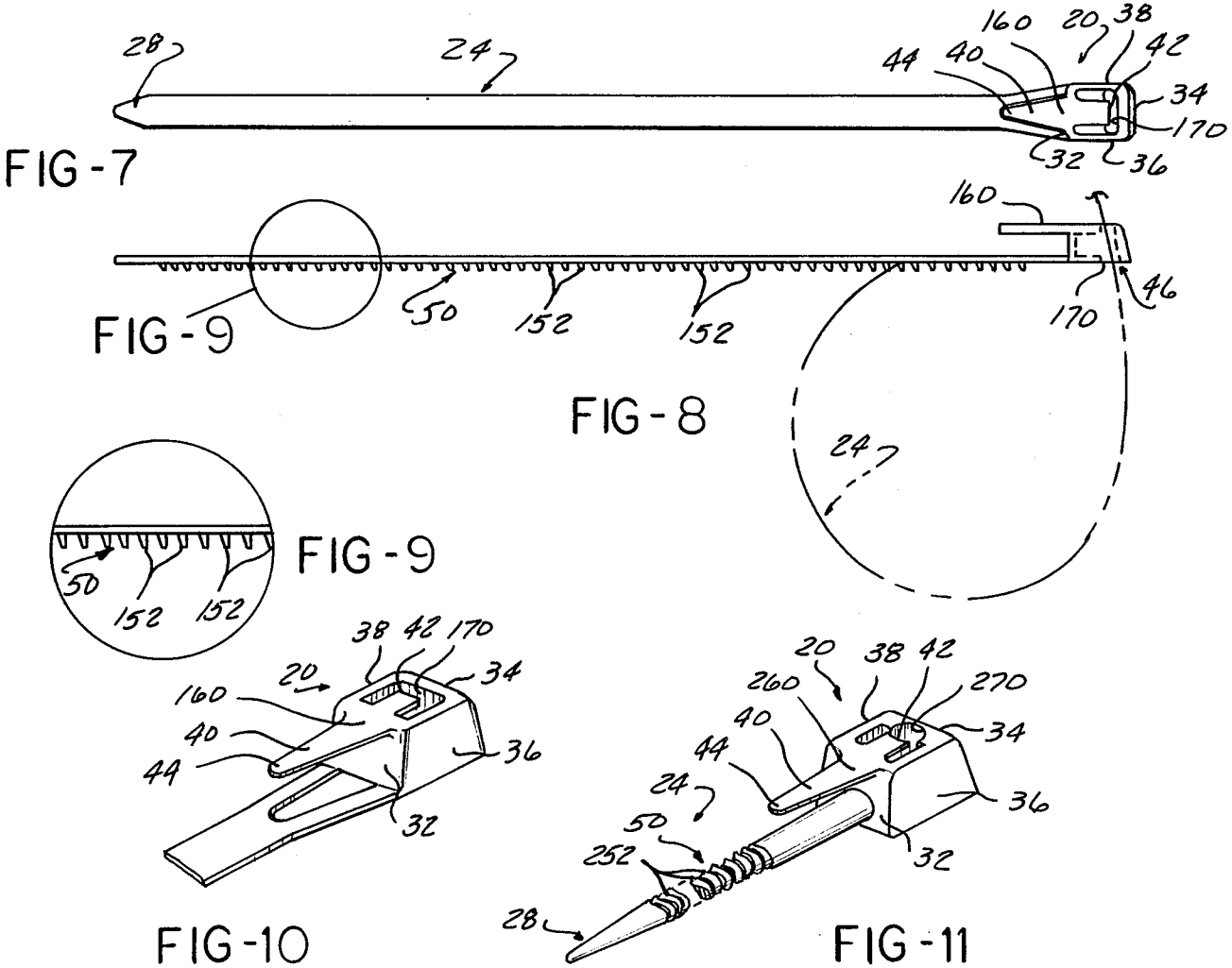
FIG. 7 is a top view of a second embodiment of the improved closure device of the present invention.
FIG. 8 is a side view of the second embodiment of the improved closure device.
FIG. 9 is a detailed view of the longitudinally spaced, lateral serrations formed on the bottom of the second embodiment of the improved closure device.
FIG. 10 is a perspective view of the retaining housing of the second embodiment of the improved closure device.
FIG. 11 is a perspective view of the retaining housing of a third embodiment of the improved closure device.

FIG. 11 is a perspective view of a third embodiment of the present invention. As in the previous two embodiments, the closure device is generally an elongated member having a longitudinal axis, a retaining housing 20 at one end, a flexible middle section 24, and a free end portion 28 at an opposite end. The retaining housing 20 has a first wall 32 connected to the middle section 24, a second wall 34 opposing the first wall 32, third and fourth walls, 36 and 38 respectively, opposing each other and formed integrally with the first wall 32 and the second wall 34. The retaining housing 20 also has lever means 40 connected to the first wall 32 for releasably retaining the middle section 24. The lever means 40 includes a middle-section-engaging surface 42, a press-to-release-actuating end 44, and is biased against movement in one direction. The retaining housing 20 also has passage means 46 for receiving the free end portion 28 and the middle section 24 through the retaining housing 20. The flexible middle section 24 is constructed having shaped means 50 for releasably retaining the middle section 24 in an engaged position within the retaining housing 20 in cooperation with the middle-section-engaging surface 42 of the lever means 40. The free end portion 28 is formed having a tapered surface tapering away from the middle section 24.

In the third embodiment of the present invention, the free end member is formed having a tapered cylindrical shape. The shaped means 50 can comprise a middle section 24 having a cylindrical body with a plurality of serrations 252, extending radially and circumferentially outward, spaced along a longitudinal length of the middle section 24. In the alternative, the shaped means 50 of the third embodiment could comprise a plurality of lanceolate members similar to those shown and described in the first embodiment. The lever means 40 of the retaining housing 20 can comprise a relatively flat lever, such as lever 260, connected to the first wall 32 extending outwardly along the longitudinal axis with a middle-section-engaging surface 42 facing the second wall 34 and a press-to-release-actuating end 44 extending out toward the middle section 24. The passage means 46 can comprise a generally circular opening passing through the retaining housing 20 in between the third and fourth walls, 36 and 38 respectively, adjacent to the second wall 34 while being spaced from the first wall 32, such as passage 270 shown in FIG. 11.

In the third embodiment, the free end portion 28 can be threaded through the passage 270 in the retaining housing 20. After drawing the free end portion 28 through the passage 270, the flexible middle section 24 will be engaged by the lever means 40. The middle-section-engaging surface 42 of the lever 260 will engage with the plurality of serrations 252, or in the alternative with the plurality of lanceolate members similar to those shown and described in the first embodiment, such that the lever 260 will resist disengaging movement of the middle section 24 while allowing further engaging movement of the middle section 24, and will also permit disengaging movement of the middle section 24 when the press-to-release-actuating end 44 of the lever 260 is depressed to create an enlarged passage 270 allowing the middle section 24 to pass freely through the retaining housing 20.

Additional changes apparent to those skilled in the art may be made to the embodiments of the invention described above without departing from the scope thereof. It is intended that all matter contained herein be interpreted in an illustrative and not a limiting sense.

What is claimed is:

1. A bag tie with press release lever comprising:

an elongated member having a longitudinal axis, a retaining housing at one end, a flexible middle section, and a free end portion at another end;

a first wall of the retaining housing opposing a second wall of the retaining housing;

third and fourth walls of the retaining housing opposing each other and formed integrally with the first and second walls;

passage means for receiving the free end portion and the middle section through the retaining housing;

a corniculate lever connected at a narrow end to the first wall of the retaining housing for releasably retaining the middle section and disposed between said third and fourth walls with an enlarged outer extremity end extending above the second wall, said corniculate lever having a middle-section-engaging surface on a concave side of said lever, a press-to-release-actuating end, and is biased against movement of the enlarged outer extremity end below the second wall;

shaped means on the flexible middle section for releasably retaining the middle section in an engaged position within the retaining housing in cooperation with said middle-section-engaging surface of said lever; and a tapered surface of the free end portion tapering away from said middle section.

2. The bag tie of claim 1, wherein the shaped means comprises a plurality of lanceolate members interconnected with a narrow end of each lanceolate member oriented toward said free end portion and an enlarged outer extremity end of each lanceolate member oriented toward said retaining housing.

3. The bag tie of claim 1, wherein the passage means comprises two opposing slots extending upwardly from bottoms of said third and fourth walls respectively, and said concave side of said lever.

4. The bag tie of claim 1, further comprising the free end portion having a tapered cylindrical shape.

5. The bag tie of claim 1, wherein the shaped means comprises the middle section having a cylindrical body with a plurality of serrations extending radially and circumferentially outward spaced along a longitudinal length of said middle section.

6. A bag tie with press release lever comprising:

an elongated member having a longitudinal axis, a retaining housing at one end, a flexible middle section, and a free end portion at another end;

a first wall of the retaining housing connected to the middle section;

a second wall of the retaining housing opposing the first wall;

third and fourth walls of the retaining housing opposing each other and formed integrally with the first and second walls;

passage means for receiving the free end portion of the middle section through the retaining housing;

a lever connected to the first wall with a middle-section-engaging surface of the lever spaced away from the first wall to oppose the second wall, and a press-to-release-actuating end extending outward from the first wall toward the middle section;

shaped means on the flexible middle section for releasably retaining the middle section in an engaged position within the retaining housing in cooperation with said middle-section-engaging surface of said lever; and a tapered surface of the free end portion tapering away from said middle section.

7. The bag tie of claim 6, wherein the passage means comprises a semicircular aperture passing through the retaining housing in between the third and fourth walls, and adjacent to the second wall while spaced from the first wall. retaining housing in between the third and fourth walls, and adjacent to the second wall while spaced from the first wall.

8. The bag tie of claim 7, wherein the shaped means comprises the middle section having a cylindrical body with a plurality of serrations extending radially and circumferentially outward spaced along a longitudinal length of said middle section.

9. The bag tie of claim 7, wherein the shaped means comprises a plurality of lanceolate members interconnected with a narrow end of each lanceolate member oriented toward said free end portion and an enlarged outer extremity end of each lanceolate member oriented toward said retaining housing.

10. The bag tie of claim 6, wherein the passage means comprises a relatively flat, rectangular aperture passing through the retaining housing in between the third and fourth walls, and adjacent to the second wall while spaced from the first wall.

11. The bag tie of claim 10, wherein the shaped means comprises the middle section having a flat, rectangular shape with a plurality of longitudinally spaced, lateral serrations disposed on a bottom surface thereof.

12. The bag tie of claim 6, wherein the free end portion has a flat, relatively smooth, laterally tapered shape tapering away from the middle section.

13. The bag tie of claim 6, further comprising the free end portion having a tapered cylindrical shape.

14. A bag tie with press release lever comprising:

an elongated member having a longitudinal axis, a retaining housing at one end, a flexible middle section, and a free end portion at another end;

a first wall of the retaining housing connected to the middle section;

a second wall of the retaining housing opposing the first wall;

third and fourth walls of the retaining housing opposing each other and formed integrally with the first and second walls;

a passage for receiving the free end portion and the middle section through the retaining housing, said passage defined by opposing slots formed in the third and fourth walls respectively, extending upwardly from bottom surfaces of the third and fourth walls respectively;

a corniculate lever for releasably retaining the middle section within the retaining housing, with a narrow end of the lever connected to the first wall, said lever extending between the third and fourth walls with an enlarged-outer-extremity-press-to-release-actuating end extending above the second wall, said lever having a middle-section-engaging surface on a concave side of the lever, and said lever biased against pivotal movement of the enlarged outer extremity end below the second wall;

a plurality of lanceolate members formed on the middle section for releasably retaining the middle section in an engaged position within the retaining housing in cooperation with the middle-section-engaging surface of the lever, said plurality of lanceolate members interconnected with a narrow end of each lanceolate member oriented toward the free end portion and an enlarged outer extremity end of each lanceolate member oriented toward the retaining housing; and a tapered cylindrical surface on the free end portion of the elongated member tapering away from the middle section, wherein the free end portion and the middle section of the elongated member are capable of being passed through the passage in the third and fourth walls, passing over the corniculate lever and contacting the middle-section-engaging surface of the lever, such that the lever engages with the narrow end of one of the plurality of lanceolate members to retain the middle section in the engaged position between the middle-section-engaging surface of the lever and the opposing slots of the third and fourth walls respectively, said enlarged outer extremity end of an adjacent lanceolate member preventing disengaging movement of the middle section due to the lever obstructing the passage, and wherein moving the enlarged-outer-extremity-press-to-release-actuating end of the lever toward the second wall creates an enlarged passage allowing the plurality of lanceolate members to pass freely through the retaining housing.

15. A bag tie with press release lever comprising:

an elongated member having a longitudinal axis, a retaining housing at one end, a flexible, cylindrical middle section, and a free end portion at another end;

a first wall of the retaining housing connected to the middle section;

a second wall of the retaining housing opposing the first wall;

third and fourth walls of the retaining housing opposing each other and formed integrally with the first and second walls;

a passage for receiving the free end portion and the middle section through the retaining housing, said passage defined by a semi-circular aperture passing through the retaining housing in between the third and fourth walls, and adjacent to the second wall while spaced from the first wall;

a lever, for releasably retaining the middle section within the retaining housing, connected to the first wall with a middle-section-engaging surface of the lever spaced away from the first wall to oppose the second wall, and a press-to-release-actuating end extending outward from the first wall toward the middle section biased against pivotal movement in one direction;

a plurality of longitudinally spaced, cylindrical serrations extending radially and circumferentially outward, formed on the middle section for releasably retaining the middle section in an engaged position within the retaining housing in cooperation with the middle-section-engaging surface of the lever; and a tapered cylindrical surface on the free end portion of the elongated member tapering away from the middle section, wherein the free end portion and the middle section of the elongated member are capable of being passed through the passage, contacting the middle-section-engaging surface of the lever, such that the lever engages with one of the plurality of serrations to retain the middle section in the engaged position between the middle-section-engaging surface of the lever and the second wall, and wherein moving the press-to-release-actuating end of the lever creates an enlarged passage allowing the plurality of serrations to pass freely through the retaining housing.

16. A bag tie with press release lever comprising:

an elongated member having a longitudinal axis, a retaining housing at one end, a flexible, relatively flat, rectangular middle section, and a free end portion at another end;

a first wall of the retaining housing connected to the middle section;

a second wall of the retaining housing opposing the first wall;

third and fourth walls of the retaining housing opposing each other and formed integrally with the first and second walls;

a passage for receiving the free end portion and the middle section through the retaining housing, said passage defined by a relatively flat, rectangular aperture passing through the retaining housing in between the third and fourth walls, and adjacent to the second wall while spaced from the first wall;

a lever, for releasably retaining the middle section within the retaining housing, connected to the first wall with a middle-section-engaging surface of the lever spaced away from the first wall to oppose the second wall, and a press-to-release-actuating end extending outward from the first wall toward the middle section, biased against pivotal movement in one direction;

a plurality of longitudinally spaced, lateral serrations formed on a bottom surface of the middle section for releasably retaining the middle section in an engaged position within the retaining housing in cooperation with the middle-section-engaging surface of the lever; and a flat, relatively smooth, laterally tapered surface on the free end portion of the elongated member tapering away from the middle section, wherein the free end portion and the middle section of the elongated member are capable of being passed through the passage contacting the middle-section-engaging surface of the lever, such that the lever engages with one of the plurality of serrations to retain the middle section in the engaged position between the middle-section-engaging surface of the lever and the second wall, and wherein moving the press-to-release-actuating end of the lever creates an enlarged passage allowing the plurality of serrations to pass freely through the retaining housing.

* * * * *

UNITED STATES PATENT AND TRADEMARK OFFICE

CERTIFICATE OF CORRECTION

PATENT NO. : 4,711,002

DATED : December 8, 1987

INVENTOR(S) : Elsmer W. Kreeger

It is certified that error appears in the above-identified patent and that said Letters Patent is hereby corrected as shown below:

In the Claims, column 6, lines 30-32, delete "retaining housing in between the third and fourth walls, and adjacent to the second wall while spaced from the first wall".

Signed and Sealed this

Seventeenth Day of May, 1988

*Attest:*

*Attesting Officer*

DONALD J. QUIGG

*Commissioner of Patents and Trademarks*